US011311796B2

(12) United States Patent
Schultheis et al.

(10) Patent No.: US 11,311,796 B2
(45) Date of Patent: Apr. 26, 2022

(54) PLAYING SURFACE FOR SPINNING TOP TOY APPARATUS AND METHODS

(71) Applicant: Hasbro, Inc., Pawtucket, RI (US)

(72) Inventors: Douglas Arthur Schultheis, Cumberland, RI (US); Luke C Lohan, Abington, MA (US)

(73) Assignee: TOMY COMPANY, LTD., Tokyo (JP)

( * ) Notice: Subject to any disclaimer, the term of this patent is extended or adjusted under 35 U.S.C. 154(b) by 61 days.

(21) Appl. No.: 17/005,441

(22) Filed: Aug. 28, 2020

(65) Prior Publication Data

US 2021/0060411 A1 Mar. 4, 2021

Related U.S. Application Data

(60) Provisional application No. 62/893,435, filed on Aug. 29, 2019.

(51) Int. Cl.
*A63H 1/00* (2019.01)
*A63F 9/16* (2006.01)

(52) U.S. Cl.
CPC ..... *A63F 9/16* (2013.01); *A63H 1/00* (2013.01)

(58) Field of Classification Search
CPC ..... A63H 1/00; A63F 3/00214
See application file for complete search history.

(56) References Cited

U.S. PATENT DOCUMENTS 755,446 A 3/1904 Butcher
1,552,530 A * 9/1925 Woods ..... A63F 9/16
273/108.1
1,594,649 A 8/1926 Trautmann
2,148,374 A 2/1939 Hogan
2,195,083 A 3/1940 Einfalt
2,364,117 A 12/1944 Wigal
2,611,995 A 9/1952 Krapp
2,736,132 A 2/1956 Murray
3,191,341 A * 6/1965 Martin ..... A63H 1/00
446/264
3,229,416 A 1/1966 Bross
3,235,259 A 2/1966 Glass et al.
(Continued)

FOREIGN PATENT DOCUMENTS

JP 4659153 B2 3/2008
WO 2013016317 A2 1/2013

*Primary Examiner* — John A Ricci
(74) *Attorney, Agent, or Firm* — Perry Hoffman

(57) ABSTRACT

A toy battle arena game and method for manufacturing an asymmetrical battling stadium providing unique arena having four inclined battling surface curved regions collectively creating an asymmetrical concave bowl-shaped battling stadium for generating unpredictable top action about and around an asymmetrical battling surface for exciting and dynamic game play in a relatively small arena. Four semi-circular or curved inclined surfaces each includes a banked corner and are each defined by arc segment with a radius prescribing a midpoint of each arc segment. Connecting midpoints of each arc segment or partial sphere delineates an irregular quadrilateral in a central area of stadium to collectively create an asymmetrical battling surface which enhances game play by maximizes random and dynamic interactions between actively spinning tops about and around the asymmetrical battling surface.

20 Claims, 14 Drawing Sheets

(56) References Cited

U.S. PATENT DOCUMENTS

| | | | | | |
|---|---|---|---|---|---|
| 3,531,892 | A | | 10/1970 | Pearce | |
| 3,674,271 | A | * | 7/1972 | De Gelder | A63H 1/00 273/115 |
| 3,841,636 | A | | 10/1974 | Meyer | |
| 3,864,870 | A | | 2/1975 | Breslow et al. | |
| 3,945,146 | A | | 3/1976 | Brown | |
| 4,185,739 | A | | 1/1980 | Wilford | |
| 4,200,283 | A | * | 4/1980 | Andrews | A63F 9/16 273/108 |
| 4,261,466 | A | | 4/1981 | Wilford | |
| 4,476,650 | A | | 10/1984 | Lokvig | |
| 4,695,262 | A | | 9/1987 | Crosby et al. | |
| 4,713,039 | A | | 12/1987 | Wong | |
| 4,867,727 | A | | 9/1989 | Lanius | |
| 4,959,035 | A | | 9/1990 | Murasaki | |
| 4,982,961 | A | * | 1/1991 | Ichimura | A63F 9/16 273/109 |
| 5,110,128 | A | | 5/1992 | Robbins | |
| 5,411,138 | A | | 5/1995 | Klawiter | |
| 5,458,523 | A | | 10/1995 | Aoki et al. | |
| 5,823,845 | A | | 10/1998 | O'Berrigan | |
| 5,896,991 | A | | 4/1999 | Hippely et al. | |
| 5,957,745 | A | | 9/1999 | Johnson et al. | |
| 6,099,380 | A | | 8/2000 | Rasmussen | |
| 6,270,391 | B1 | | 8/2001 | Emilsson | |
| 6,280,286 | B1 | | 8/2001 | Andrews | |
| 6,406,349 | B1 | | 6/2002 | Chung | |
| 6,676,476 | B1 | | 1/2004 | Lund et al. | |
| 7,037,169 | B2 | | 5/2006 | Benedek et al. | |
| 7,296,679 | B2 | | 11/2007 | Lam | |
| 7,389,987 | B1 | | 6/2008 | Paukert | |
| 7,475,881 | B2 | | 1/2009 | Blagg et al. | |
| 7,740,518 | B2 | | 6/2010 | Elliott | |
| 8,137,151 | B2 | | 3/2012 | Kenney | |
| 9,901,811 | B2 | * | 2/2018 | Shindo | A63F 9/16 |
| 9,962,615 | B2 | * | 5/2018 | Lema | A63F 13/213 |
| 10,702,767 | B2 | * | 7/2020 | Campos | A63F 9/16 |
| D912,157 | S | * | 3/2021 | Hama | A63F 13/213 D21/338 |
| 11,154,769 | B2 | * | 10/2021 | Schultheis | A63F 9/16 |
| 2003/0168801 | A1 | | 9/2003 | Zucchi et al. | |
| 2004/0040349 | A1 | | 3/2004 | Guttadauro et al. | |
| 2005/0104294 | A1 | | 5/2005 | Chen | |
| 2006/0255149 | A1 | | 11/2006 | Retter et al. | |
| 2016/0030848 | A1 | | 2/2016 | Lema et al. | |
| 2016/0035178 | A1 | | 2/2016 | Judkins et al. | |
| 2017/0239558 | A1 | * | 8/2017 | Shindo | A63F 9/16 |

* cited by examiner

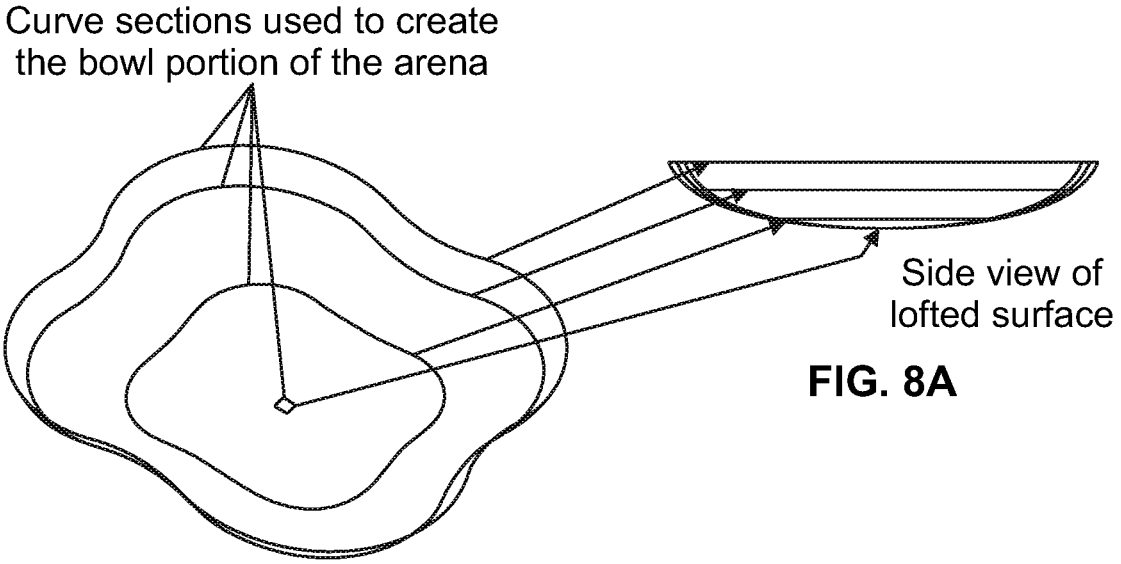
FIG. 8A
FIG. 8
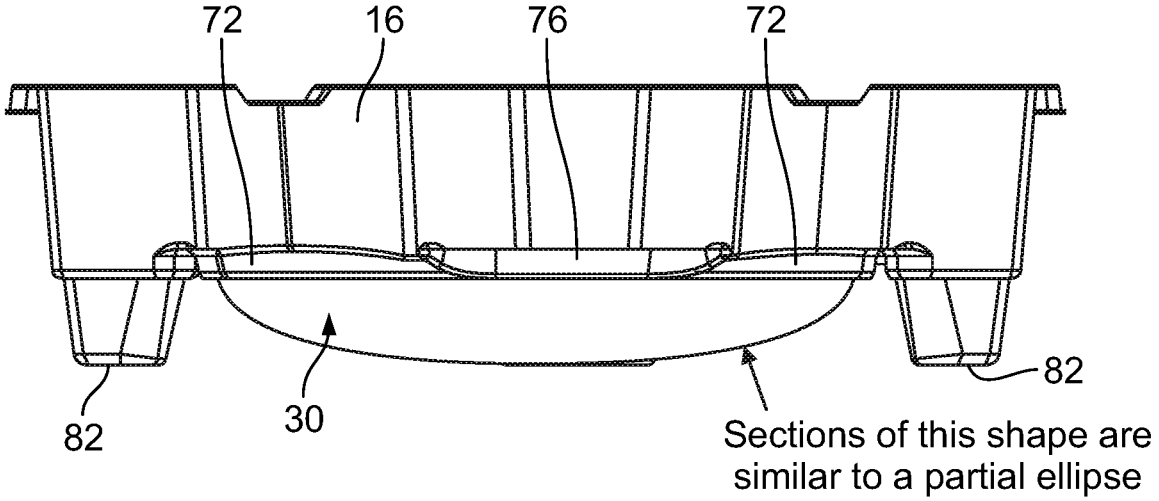
FIG. 9

PLAYING SURFACE FOR SPINNING TOP TOY APPARATUS AND METHODS

PRIORITY CROSS-REFERENCE TO RELATED APPLICATION

This application claims priority pursuant to 35 U.S.C. 119(e) or 120 from U.S. Provisional Application No. 62/893,435 filed Aug. 29, 2019 for inventions disclosed therein incorporated by reference.

BACKGROUND OF THE INVENTION

1. Field of Invention

The present invention relates to a battle arena game apparatus, and more particularly, to a battle arena apparatus employing four inclined surfaces defined by four respective partial spheres defining an irregular top perimeter edge creating an asymmetrical concave bowl-shaped battling stadium for generating unpredictable top action for exciting and dynamic game play in a relatively small arena.

The inventions discussed in connection with the described embodiments addresses various deficiencies of the prior art. The present inventions address gaming systems and the like directed to playing surfaces for spinning toys, apparatus and methods designed to enhance game play by maximizing random and dynamic interactions between actively spinning tops about and around an asymmetrical concave bowl-shaped battling surface. The asymmetrical battling stadium provides a novel arena having four inclined battling surface curved regions collectively creating an asymmetrical concave bowl-shaped battling stadium for generating unpredictable top action about and around an asymmetrical battling. Connecting midpoints of each arc segment or partial sphere delineates an irregular quadrilateral in a central area of stadium to collectively create an asymmetrical battling surface which enhances game play. Four semi-circular or curved inclined surfaces each includes a banked corner and are each defined by arc segment with a radius prescribing a midpoint of each arc segment. Connecting midpoints of each arc segment or partial sphere delineates an irregular quadrilateral in a central area of stadium to collectively create an asymmetrical battling surface which enhances game play. Four semi-circular inclined battling surfaces, each with a banked corner defined by a partial sphere and radius prescribing a midpoint of each partial sphere, collectively form an asymmetrical concave bowl-shaped battling surface. Connecting the midpoints of each of the four partial spheres delineates an irregular quadrilateral in a central area of the concave bowl collectively creating the asymmetrical battling surface.

2. Description of Related Art

There are known toy play pads and battle arenas which provide a surface along which toy tops are spun and travel in a specified direction, along a rail or track element, or travel around a circular platform. It is known to employ a circular arena for providing a surface on which toy tops can spin and possibly interact with one another, or to provide a rail or track element to guide a toy top along the direction of the rail or track. It is also known to provide a clover-shaped playing surface with a vibratory means or manually manipulated rotatable shafts to move around a plurality of playing pieces.

There is a known toy top play pad which employs a circular launch pad and runway pad in juxtaposition with the launch pad as exemplified and disclosed in JP4659153 titled "Game Table for a toy top", issued Mar. 27, 2008 to Jenoido Pronto Design KK. Toy tops are spun into the circular launch pad where they revolve around the perimeter of the concave launch pad and discharge onto a runway pad in a racing fashion. A guide plate directs the tops only from the launch pad to the running pad where a user can race tops through running grooves and compete for running speeds.

The circular launch pad is only a landing pad for toy tops to be introduced to the play pad before they are captured by the running grooves as the toy tops circle the outer perimeter of the circular launching pad. The toy tops enter the running grooves and are then directed around the runway pad circuit in a racing fashion and never collide in the circular launch pad.

There are also known battle arena game apparatuses including an arena or stadium for a game of spinning battle tops. The arenas can accommodate two players when placed in one orientation and four players after being flipped to another configuration. It is also known to provide an interactive tops collision enhancing battling environment battle arena, having symmetrical side tracks for redirecting spinning tops at a periphery of the battle arena, back into a middle of a battling surface by providing an entrance to each side track at the periphery of the battle arena and an exit at each side track at an end opposite the entrance.

Beyblade™ spinning tops are known as physical game pieces. The described Beyblade™ spinning top usually includes a device, such as a ripcord, to help a player make the top spin. One or more players may engage in games where one or more players spin two or more tops so that the tops may "battle", where the player whose top is the last top spinning wins. The "battle" may include the tops colliding one or more times. The tops may have different designs where each design causes a top to respond to collision in a unique way, thus adding a skill element to choosing opposing tops. In some embodiments, the game may further use physical game battle arena game apparatus in an integrated multi-environment interactive battle game physical game board, convertible or converting arena, e.g., being turned upside down and used as a stadium for plural or multiple players to spin two or more Beyblade™ tops so that the tops battle within the stadium confines by spinning and knocking into each other until only one top remains spinning and/or continually redirected from the periphery of the battling arena back into the middle of the battling surface enhancing collisions of the spinning tops in battle.

It is also known to provide a clover-shaped playing surface with a vibratory means or manually manipulated rotatable shafts to move around a plurality of playing pieces as exemplified and disclosed in expired U.S. Pat. No. 3,841,636, titled "Vibratory Game", issued Oct. 15, 1974, to Burton C. Meyer. A clover-shaped horizontal playing surface is defined by a stiffly resilient sheet member supported on a frame and supports a plurality of playing pieces which move in response to vibration of the sheet member. The clover-shaped playing surface is disclosed as a generally flat planar surface with a clover-shaped wall around the entire perimeter defining the flat planar horizontal playing surface. The clover shaped wall also defines four identically shaped and sized areas within the flat planar horizontal playing surface collectively delineating a flat symmetrical play surface. A vibratory motor or alternatively, a plurality of manually manipulated rotatable shafts is disclosed to vibrate the horizontal sheet member or manually manipulate the plurality of playing pieces. The game apparatus is also equipped with push-button levers including pins protruding through the playing surface to permit players to upset their opponents playing pieces as they move over the playing surface.

Significantly, known toy top play pads and battle arenas do not disclose a battling stadium apparatus having an asymmetrical concave bowl-shaped battling surface generating unpredictable top action about and around the asymmetrical battling surface for exciting and dynamic game play in a relatively small arena. It would be desirable to provide four semi-circular inclined battling surfaces, each with a banked corner defined by a partial sphere and radius prescribing a midpoint of each partial sphere, to collectively form an asymmetrical concave bowl-shaped battling surface. Connecting the midpoints of each of the four partial spheres delineates an irregular quadrilateral in a central area of the concave bowl collectively creating the asymmetrical battling surface.

SUMMARY OF THE INVENTION

The present invention addresses shortcomings of the prior art to provide a battling stadium with an asymmetrical concave bowl-shaped battling surface that promotes random movements of hypersphere tops in battle to enhance game play by maximizing random and dynamic interactions between actively spinning tops about and around the battling surface. The asymmetrical battling stadium provides an arena having four inclined battling surface curved regions collectively creating an asymmetrical concave bowl-shaped battling stadium for generating unpredictable top action about and around an asymmetrical battling surface for exciting and dynamic game play in a relatively small arena. Connecting midpoints of each arc segment or partial sphere delineates an irregular quadrilateral in a central area of stadium to collectively create an asymmetrical battling surface which enhances game play. Four inclined battling surfaces collectively form an asymmetrical concave bowl-shaped battling surface. The four battling surfaces each include a banked corner and are each defined by a partial sphere that includes a radius which prescribes a midpoint of each partial sphere. Connecting the midpoints of each of the four partial spheres delineates an irregular quadrilateral in a central area of the stadium to collectively create the asymmetrical battling surface.

In one embodiment of the invention, a battling stadium includes an asymmetrical concave bowl-shaped battling surface defining a top perimeter edge which is irregular and non-circular in shape. Four inclined battling surfaces define the asymmetrical concave bowl-shaped battling surface such that the inclined surfaces are semi-circular in shape at the top perimeter edge and curve or blend downward toward an elliptical shape as the battling surfaces slope away from the top perimeter edge. The irregular shape of each of the four inclined battling surfaces creates random and interesting interactions between actively spinning tops about and around the asymmetrical concave bowl-shaped battling surface for enhanced and extended game play.

In one embodiment of the invention, a battling stadium apparatus for tops with an asymmetrical battling surface includes a first tier having a concave bowl-shaped stadium including four semi-circular inclined battling surfaces, a first semi-circular inclined battling surface including a banked corner defined by a first partial sphere having a first radius prescribing a midpoint of the first partial sphere, a second semi-circular inclined battling surface including a banked corner defined by a second partial sphere having a second radius prescribing a midpoint of the second partial sphere, a third semi-circular inclined battling surface including a banked corner defined by a third partial sphere having a third radius prescribing a midpoint of the third partial sphere, and a fourth semi-circular inclined battling surface including a banked corner defined by a fourth partial sphere having a fourth radius prescribing a midpoint of the fourth partial sphere. First, second, third and fourth radii each come to a terminus defining a midpoint of a respective partial sphere collectively delineating an irregular quadrilateral connecting each of the first, second, third and fourth midpoints creating an asymmetrical battling environment at the four semi-circular inclined battling surfaces of the bowl-shaped stadium.

In another embodiment of the invention, the battling stadium apparatus further includes a second tier atop the first tier including a riding platform surface disposed at a border between the first and second tiers, the border defining an upper edge of the four semi-circular inclined battling surfaces creating a deep-seated asymmetrical stadium bowl generating unpredictable top action for exciting and dynamic game play in a relatively small arena. In another embodiment, the battling stadium apparatus further a border wall adjacent the border between first and second tiers disposed at the banked corner of one or more of the four semi-circular inclined battling surfaces, and further includes one or more wells defined by the one or more border walls for capturing exiting tops spun beyond first and second tiers of the battling stadium.

In another embodiment of the invention, first, second, third and fourth partial sphere midpoints collectively delineate a parallelogram without right angles connecting each of the first, second, third and fourth midpoints creating an asymmetrical battling environment at the four semi-circular inclined battling surfaces of the bowl-shaped stadium. In another embodiment, first, second, third and fourth partial sphere midpoints collectively delineate a parallelogram with right angles connecting each of the first, second, third and fourth midpoints creating an asymmetrical battling environment at the four semi-circular inclined battling surfaces of the bowl-shaped stadium.

In yet another embodiment of the invention, one or more of the four semi-circular inclined battling surfaces extends from the border between then first and second tiers at a sharp angle defining a sharp incline into a deep-seated battling surface. In another embodiment, the riding platform surface of the second tier includes an inclined portion for directing tops riding on the second tier back into the middle of the first tier of the stadium bowl, and in still yet another embodiment, the stadium is in further combination with a top having a wide U-shaped tip for contacting and spinning along the deep-seated asymmetrical stadium bowl at an enhanced acceleration.

In another embodiment of the invention, a toy stadium apparatus for battling tops includes a first tier battling arena having a concave bowl-shaped surface having a central area and first, second, third and fourth quadrant areas along the periphery of the central area, the quadrant areas each being adjacent the central area and inclined therefrom, a first partial sphere banked surface at the first quadrant area with a corner defined by a first semi-circular area having an extent determined by the length of a first radius from a first specified point in the central area of the concave bowl-shaped surface, a second partial sphere banked surface at the second quadrant area with a corner defined by a second semi-circular area having an extent determined by the length of a second radius from a second specified point in the central area of the concave bowl-shaped surface, a third partial sphere banked surface at the third quadrant area with a corner defined by a third semi-circular area having an extent determined by the length of a third radius from a third specified point in the central area of the concave bowl-shaped surface, and a fourth partial sphere banked surface at the fourth quadrant area with a corner defined by a fourth semi-circular area having an extent determined by the length of a fourth radius from a fourth specified point in the central area of the concave bowl-shaped surface. The first, second, third and fourth specified points in the central area from which each respective first, second, third and fourth radii emanates together delineate the four corner points of an irregular quadrilateral connecting said first, second, third and fourth specified points, wherein each of the first, second, third and fourth partial sphere banked surfaces defining an asymmetrical battling surface.

In another embodiment, the battling stadium further includes a second tier atop the first tier including a riding platform surface disposed at a border between the first and second tiers, the border defining an upper edge of the four partial sphere banked surfaces creating a deep-seated asymmetrical stadium bowl generating unpredictable top action for exciting and dynamic game play in a relatively small arena. In another embodiment, the battling stadium further includes a border wall adjacent the border between first and second tiers disposed at one or more of the corners at the quadrant areas of one or more of the four semi-circular battling surfaces, and in yet another embodiment, the battling stadium further includes one or more wells defined by the one or more border walls for capturing exiting tops spun beyond first and second tiers of the battling stadium.

In another embodiment of the invention, first, second, third and fourth specified points in the central area from which each respective first, second, third and fourth radii emanates together delineate the four corner points of a parallelogram with right angles connecting said first, second, third and fourth specified points, wherein each of the first, second, third and fourth partial sphere banked surfaces define an asymmetrical battling surface. In another embodiment, first, second, third and fourth specified points in the central area from which each respective first, second, third and fourth radii emanates together delineate the four corner points of a parallelogram without right angles connecting said first, second, third and fourth specified points, wherein each of the first, second, third and fourth partial sphere banked surfaces define an asymmetrical battling surface.

In yet another embodiment of the invention, one or more of the four semi-circular areas of one or more of the four quadrant areas includes an inclined battling surface which extends from the border between then first and second tiers at a sharp angle defining a sharp incline into a deep-seated battling surface. In another embodiment, the riding platform surface of the second tier includes an inclined portion for directing tops riding on the second tier back into the central area of the first tier of the concave bowl-shaped surface, and in still yet another embodiment, the battling stadium is in combination with a top having a wide U-shaped tip for contacting and spinning along the deep-seated asymmetrical concave bowl-shaped surface at an enhanced acceleration.

In another embodiment of the invention, a method for manufacturing an asymmetrical battling stadium, includes the steps of providing a first tier having a concave bowl-shaped surface with a central area and first, second, third, and fourth quadrant areas along the periphery of the central area, each of the quadrant areas being adjacent the central area and inclined therefrom, positioning a first partial sphere banked surfaces at the first quadrant area with a corner defined by a first semi-circular area having an extent determined by the length of a first radius from a specified point in the central area of the concave bowl-shaped surface, positioning a second partial sphere banked surface at the second quadrant area with a corner defined by a second semi-circular area having an extent determined by the length of a second radius from a second specified point in the central area of the concave bowl-shaped surface, positioning a third partial sphere banked surface at the third quadrant area with a corner defined by a third semi-circular area having an extent determined by the length of a third radius from a third specified point in the central area of the concave bowl-shaped surface, and positioning a fourth partial sphere banked surface at the fourth quadrant area with a corner defined by a fourth semi-circular area having an extent determined by the length of a fourth radius from a fourth specified point in the central area of the concave bowl-shaped surface. Connecting the first, second, third and fourth specified points in the central area from which each respective first, second, third and fourth radii emanates delineating the four corner points of an irregular quadrilateral wherein each of the first, second, third and fourth partial sphere banked surfaces are defining an asymmetrical battling surface.

In another embodiment, the method of manufacturing an asymmetrical battling surface, includes the following steps of providing a second tier atop the first tier, and providing a riding platform surface disposed at a border between the first and second tiers, the border defining an upper edge of the four partial sphere banked surfaces creating a deep-seated asymmetrical stadium bowl generating unpredictable top action for exciting and dynamic game play in a relatively small arena.

Briefly, the present invention provides a unique battle arena game apparatus with four semi-circular inclined surfaces collectively creating an asymmetrical concave bowl-shaped battling stadium for generating unpredictable top action about and around an asymmetrical battling surface for exciting and dynamic game play in a relatively small arena. The four semi-circular inclined surfaces each includes a banked corner and are each defined by a partial sphere with a radius prescribing a midpoint of each partial sphere. Connecting the midpoint of each partial sphere delineates an irregular quadrilateral in a central area of stadium to collectively create an asymmetrical battling surface which enhances game play by maximizes random and dynamic interactions between actively spinning tops about and around the asymmetrical battling surface.

BRIEF DESCRIPTION OF THE DRAWINGS

For the purpose of facilitating an understanding of the inventions, the accompanying drawings and description illustrate a preferred embodiment thereof, from which inventions, structure, construction, and operation, and many related advantages may be readily understood and appreciated.

FIG. 8 is a top view illustrating curved sections used to create the battling surfaces of the concaved bowl portion of the battling stadium apparatus; while FIG. 8A is a side view illustrating the lofted battling surfaces of the concave bowl portion defined by the curved sections of FIG. 8;

FIG. 9 is a side view of the battling stadium apparatus illustrating the elliptical shape of the battling surfaces toward a central area of the concaved bowl-shaped battling stadium.

DETAILED DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1:
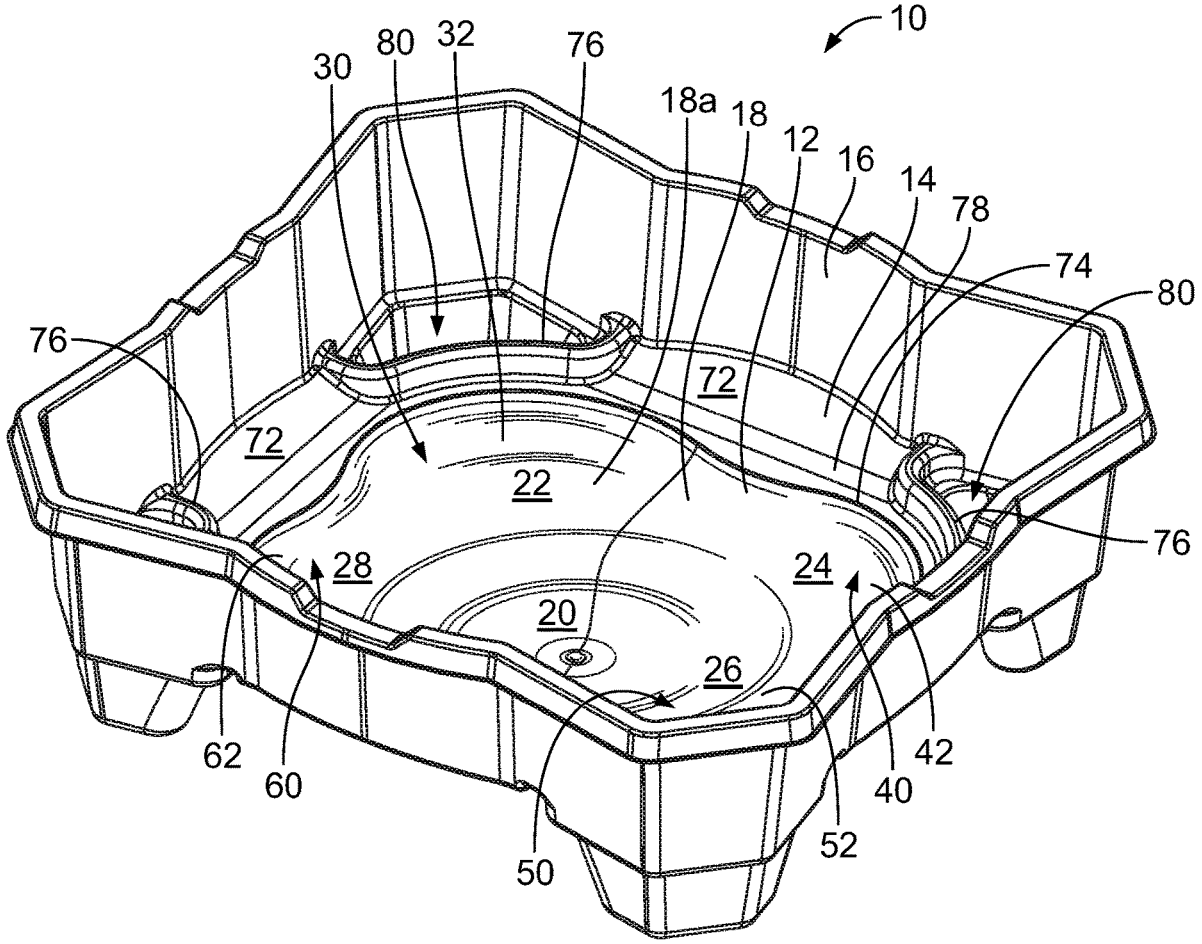
FIG. 1 is a perspective view of a battling stadium apparatus of the present invention illustrating a first tier including an asymmetrical concave bowl-shaped battling surface with four banked and inclined semi-circular surfaces/quadrants and a second tier including a boarder wall at a corner of each semi-circular surface/quadrant, with FIGS. 1A & 1B providing additional disclosure of the same perspective of the battling stadium apparatus of FIG. 1 in perspective view for tops with wide U shaped tips for riding along the bow-shaped stadium surface in a fast and aggressive manner.

A battling stadium apparatus/toy stadium apparatus for battling tops 10, as seen in FIG. 1, provides a contained space in which toy tops can be launched and is generally a one-piece molded plastic stadium-like apparatus. The asymmetrical battling stadium provides unique arena play with four inclined battling surface curved regions collectively creating an asymmetrical concave bowl-shaped battling stadium for generating unpredictable top action about and around an asymmetrical battling surface. Connecting midpoints of each arc segment or partial sphere delineates an irregular quadrilateral in a central area of stadium to collectively create an asymmetrical battling surface which enhances game play. In the present described embodiment, the stadium is a one-piece vac-formed apparatus with an exterior stadium wall to contain spinning tops within for battle for exciting and dynamic game play in a relatively small arena.

The battling stadium includes an asymmetrical concave bowl-shaped battling surface defining a top perimeter edge which is irregular and non-circular in shape. Four inclined curved battling surfaces define the asymmetrical concave bowl-shaped battling surface such that the inclined surfaces are semi-circular in shape at the top perimeter edge and curve downward in an elliptical or arc shape contour or the like as the battling surfaces slope away from the top perimeter edge. Concave arced surfaces of the battling stadium of present described embodiments may curve downward in an arc shape contour. Thus the inclined battling surface curved regions include banked corners defined by a series of arc segments having radii prescribing midpoints of respective arc segments. To this end, the inclined battling surface curved regions may be provided as semi-circular inclined battling surfaces including banked corners defined by partial spheres, each with radius prescribing a midpoint of the corresponding partial sphere. The arc segment banked surface at each quadrant area defines corners by respective inclined battling surface curved regions having an extent determined by the length of a radius from each respective specified point in the central area of the concave bowl-shaped surface. The arc segment banked surface at each quadrant area also may be defined by partial sphere banked surfaces at the each quadrant area with a corner defined by a respective semi-circular area having an extent determined by the length of a radius from a specified point in the central area of the concave bowl-shaped surface. The irregular shape of each of the four inclined battling surfaces creates random and dynamic interactions between actively spinning tops about and around the asymmetrical concave bowl-shaped battling surface for enhanced and extended game play. The described arc, elliptical or arc shape contour may be considered conventionally as a portion of a circle as described herein, where such arc may also encompass any continuous curved line or surface.

Figure 1A:
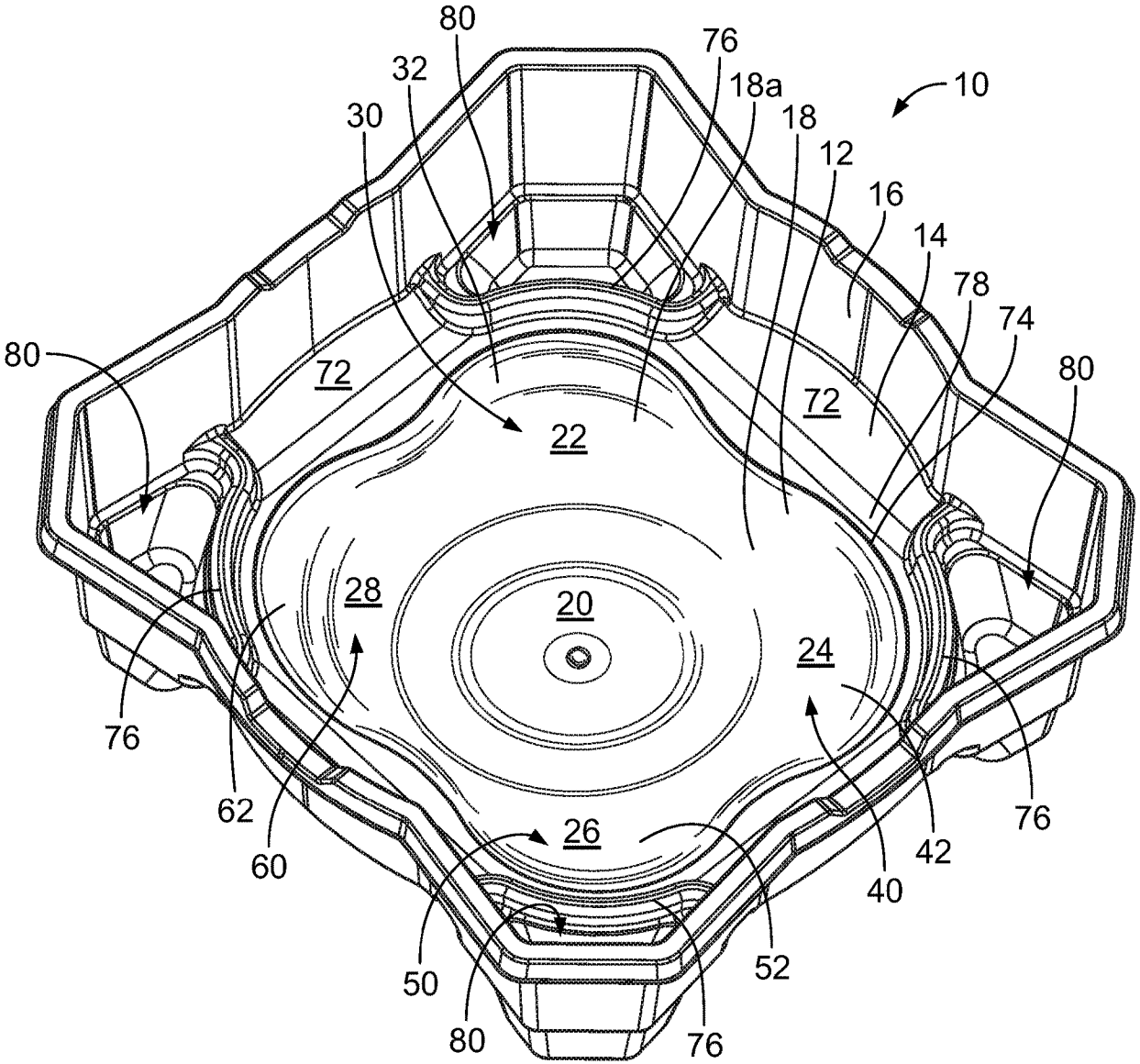
Figure 1B:
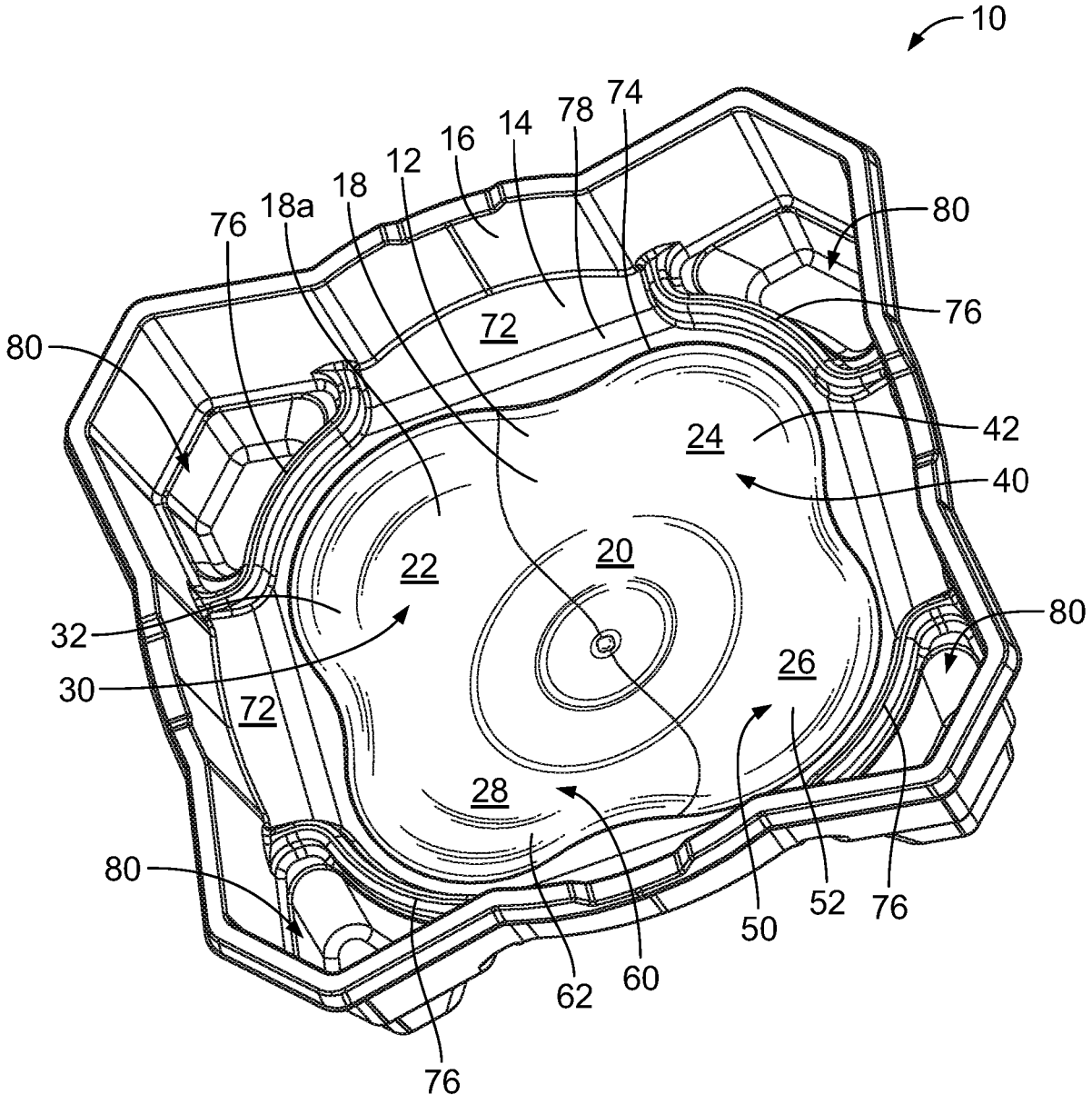
Figure 2:
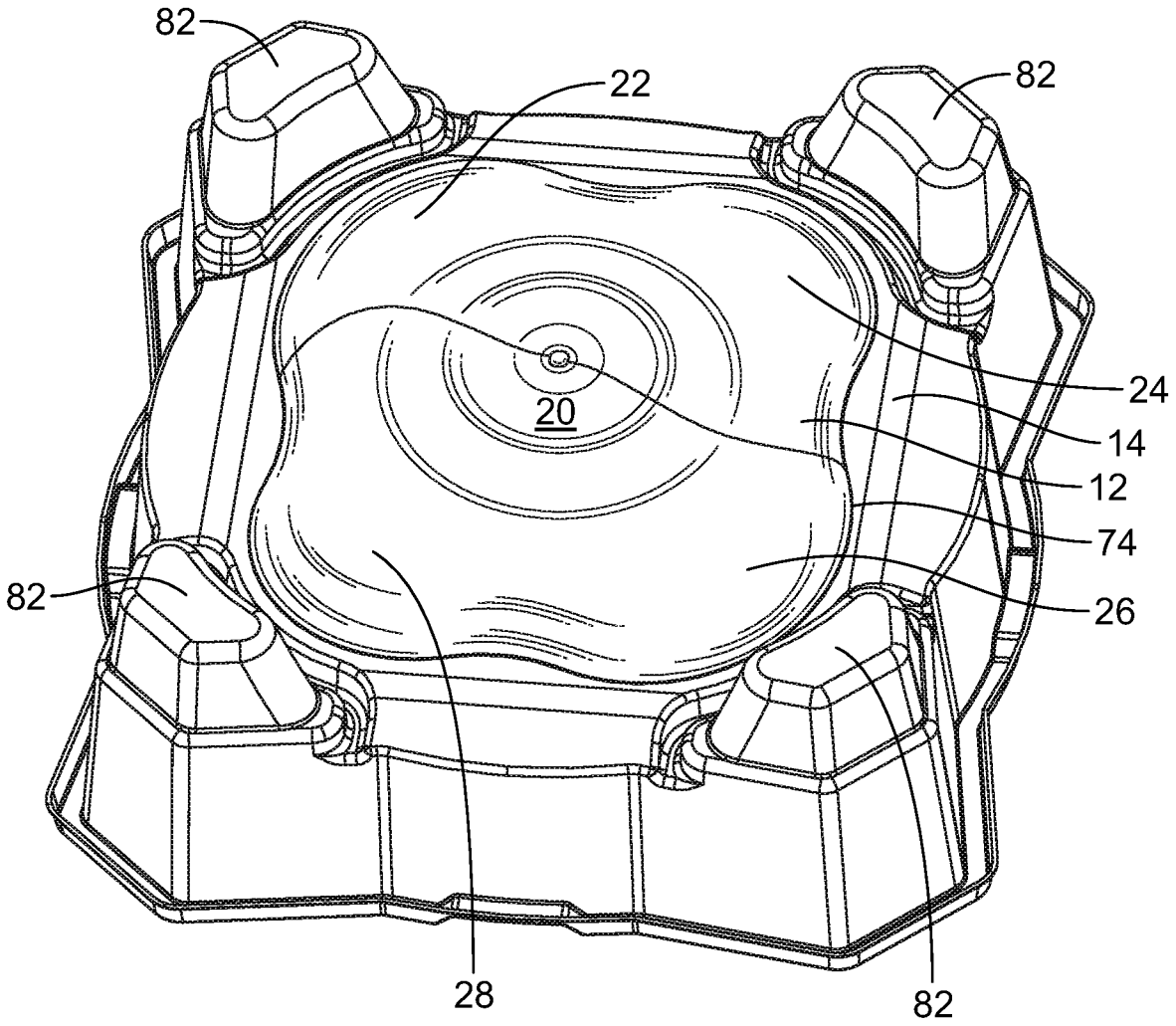
FIG. 2 is a bottom perspective view of the battling stadium apparatus, illustrating the asymmetry of each semi-circular surface/quadrant when compared to each other and a depth to the concave battling surfaces as they extend beyond the second tier to form a deep-seated asymmetrical stadium bowl, with FIGS. 2A & 2B providing additional disclosure of the same perspective view of the battling stadium of FIG. 2.
Figure 2A:
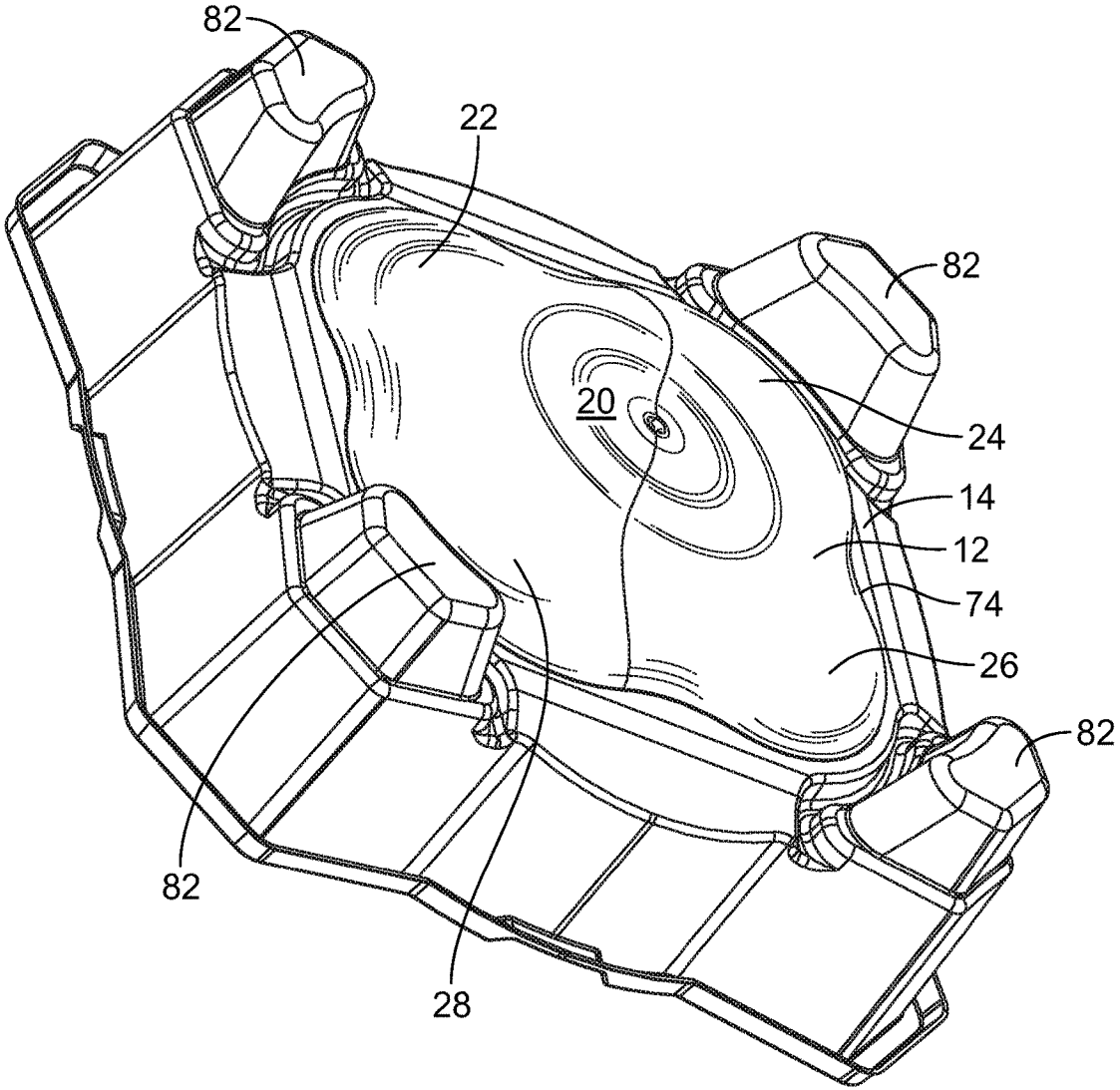
Figure 2B:
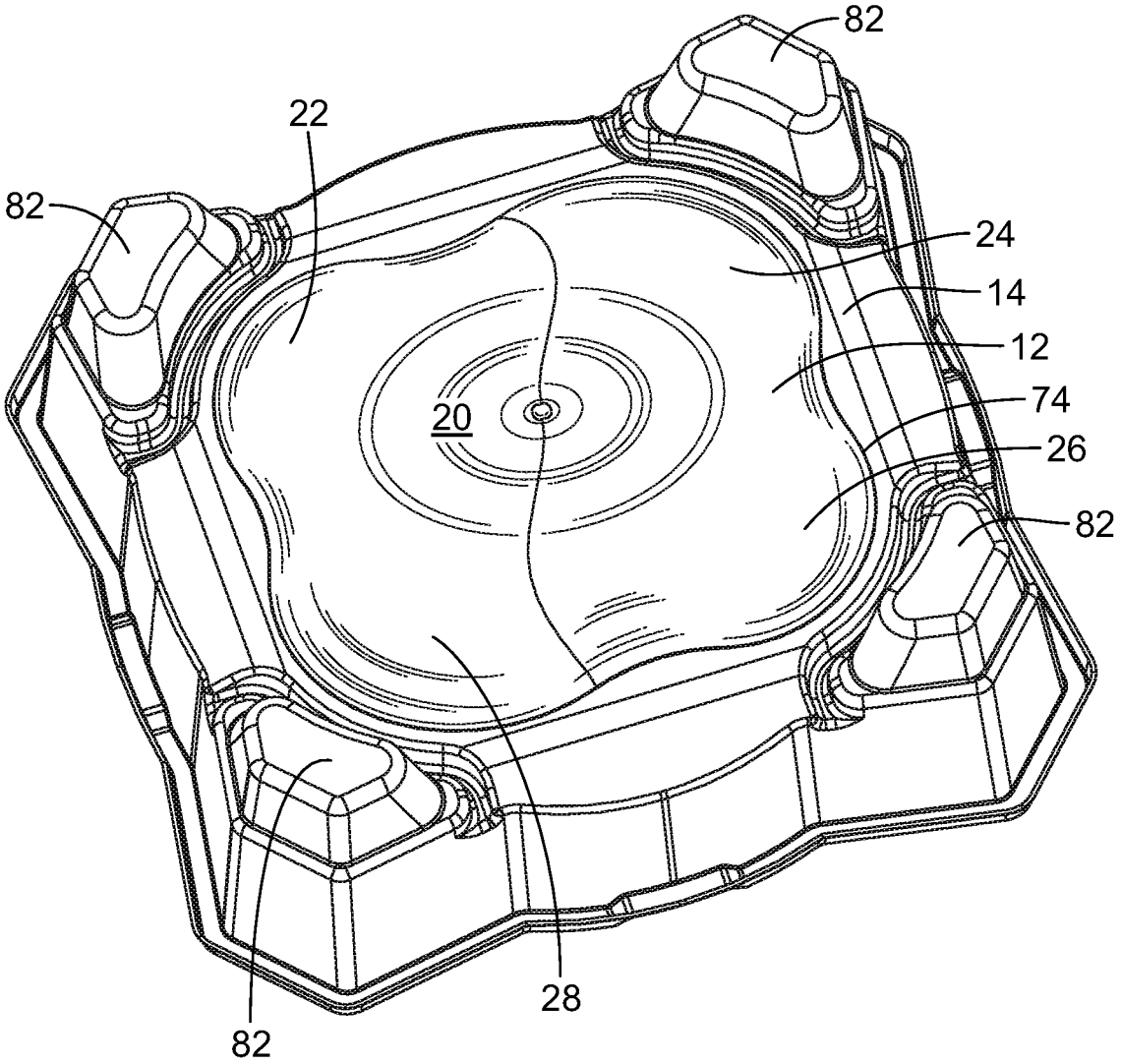

The battling stadium apparatus 10, includes two tiers, a first tier 12 and a second tier 14, and a stadium wall 16 incorporating both first and second tiers within, as seen in FIGS. 1, 1A, 1B, 2, 2A, 2B. As additional disclosure of the present described embodiment, FIGS. 1A & 1B provide additional views to FIG. 1, and likewise, additional disclosure as seen in FIGS. 2A & 2B, provide additional views to FIG. 2. The first tier includes a concave bowl-shaped stadium 18 with a battling area having a concave bowl-shaped surface 18*a*. Some convex surfaces are further included in the battling area creating an overall irregular battling surface 18*a* which provides interesting, dynamic and extended game play. The concave bowl-shaped surface 18*a* includes a central area 20 and first, second, third and fourth quadrant areas 22, 24, 26, & 28, respectively, along the periphery of the central area. The four quadrant areas are each adjacent the central area and inclined therefrom.

The bowl-shaped stadium 18 of the first tier includes four inclined battling surfaces with each one of the four battling surfaces generally defined within one of the four quadrant areas, as seen in FIG. 1. The four inclined battling surfaces, when viewed from above, as seen in the plan view of FIG. 3, define an irregular and non-circular top perimeter edge/rim 74 and are semi-circular in shape at the top perimeter edge blending downward toward an elliptical shape as the battling surfaces slope away from the top perimeter edge, as seen in FIG. 8.

Figure 3:
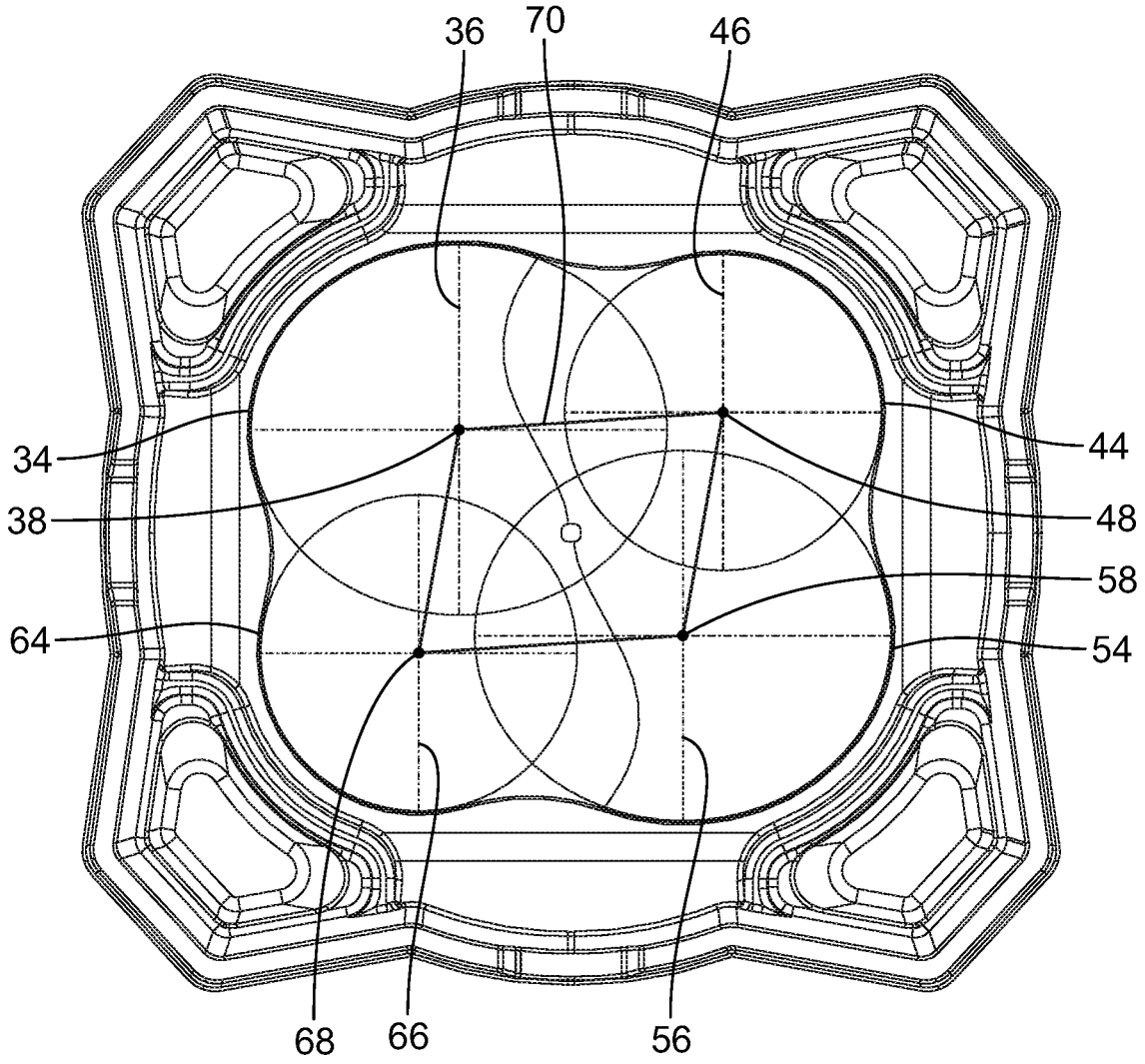
FIG. 3 is a plan view of the battling stadium apparatus, illustrating four semi-circular battling surface each defined by a partial sphere having a radius prescribing a midpoint, such that the four radii terminating at a midpoint of each of the four partial spheres collectively delineate an irregular quadrilateral, and in other words, the four semi-circular areas/quadrants each have an extent determined by a length of a radius from a specified point in a central area of the concaved bowl-shaped surface, such that the four specified points delineate four corners of an irregular quadrilateral.

As seen in FIGS. 1 & 3, a first semi-circular inclined battling surface 30, at the first quadrant area 22, includes a banked corner 32 defined by a first partial sphere 34, as seen in FIG. 3 (shown 2 dimensionally). The first partial sphere 34 includes a first radius 36 prescribing a midpoint 38 of the first partial sphere, as seen in FIG. 3. The radius 36 and midpoint 38 are defined at a plane within the envelope of the first partial sphere 34. A second semi-circular inclined battling surface 40, at the second quadrant 24, includes a banked corner 42 defined by a second partial sphere 44, as seen in FIG. 3 (shown 2 dimensionally). The second partial sphere 44 includes a second radius 46 prescribing a midpoint 48 of the second partial sphere, as seen in FIG. 3. The radius 46 and midpoint 48 are defined at a plane within the envelope of the second partial sphere 44.

Similarly, with third and fourth battling surfaces, a third semi-circular inclined battling surface 50 is disposed at the third quadrant 26 and includes a banked corner 52 defined by a third partial sphere 54 (shown 2 dimensionally). The third partial sphere 54 includes a third radius 56 prescribing a midpoint 58 of the third partial sphere. The radius 56 and midpoint 58 are defined at a plane within the envelope of the third partial sphere 54. A fourth semi-circular inclined battling surface 60, at the fourth quadrant 28, includes a banked corner 62 defined by a fourth partial sphere 64 (shown 2 dimensionally). The fourth partial sphere 64 includes a fourth radius 66 prescribing a midpoint 68 of the fourth partial sphere. The radius 66 and midpoint 68 are defined at a plane within the envelope of the fourth partial sphere 64.

As seen in FIG. 3, first, second, third and fourth radii, 36, 46, 56 & 66, respectively, each come to a terminus defining a midpoint, 38, 48, 58, 68, of a respective partial sphere, collectively delineating an irregular quadrilateral 70 connecting each of the first, second, third and fourth midpoints creating an asymmetrical battling environment at the four semi-circular inclined battling surfaces of the bowl-shaped stadium. The irregular quadrilateral lies within the envelope of the perimeter of the battling surface such as on the imaginary planar surface across the perimeter edge. The various sizes of the four battling surfaces, as seen in FIG. 3, and the convex and concave surfaces of the overall battling surface 18*a* of the concave bowl-like stadium 18, create asymmetry in the battling environment and works to redirect spinning tops about the asymmetrical battling environment in an aggressive and random manner. The asymmetrical concave bowl-shaped battling environment creates unpredictable spinning top action about and around the asymmetrical battling surface for exciting and dynamic game play in a relatively small arena.

Figure 7:
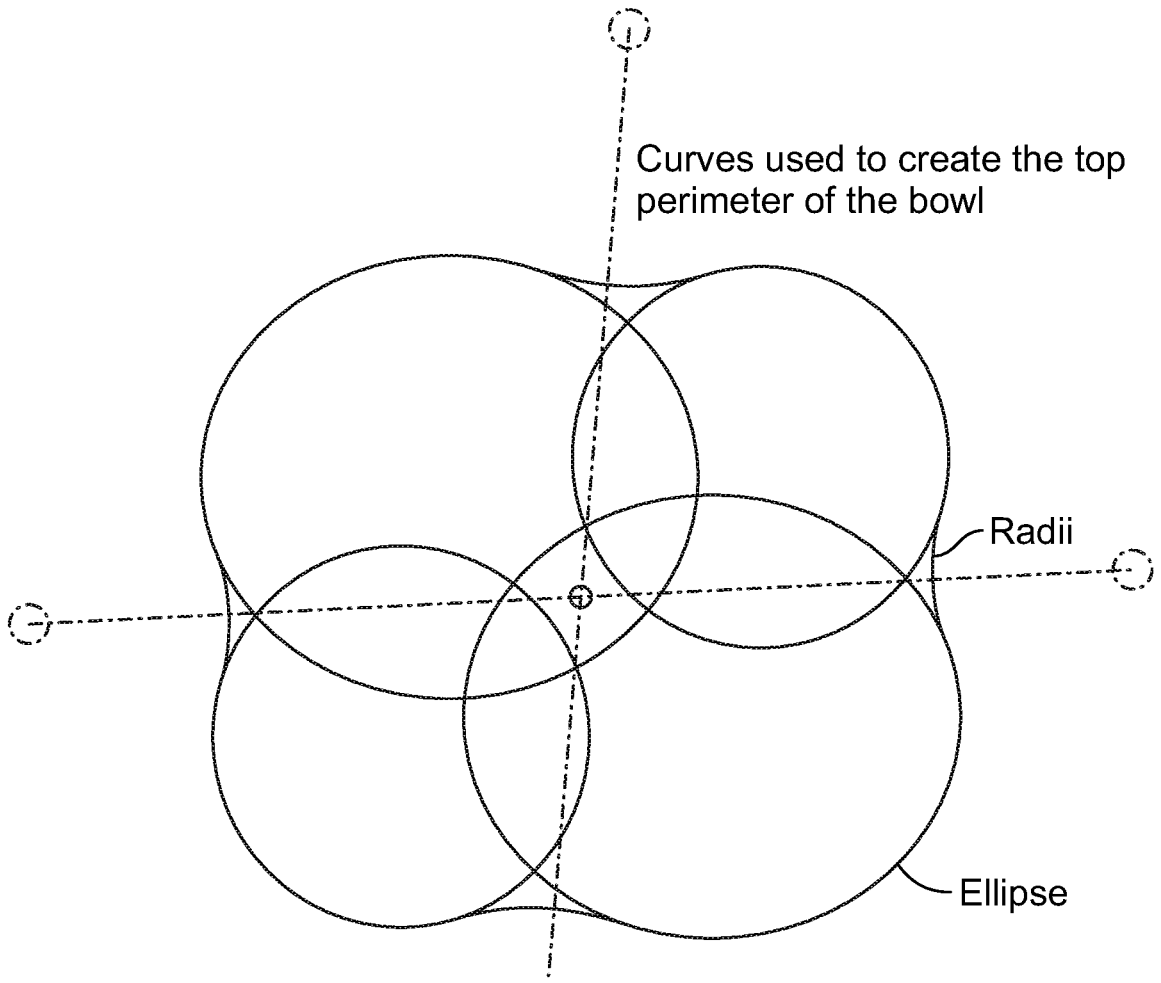
FIG. 7 is a top view of an irregular non-circular perimeter of the asymmetrical concaved bowl-shaped battling stadium apparatus illustrating four battling surfaces which are semi-circular in shape at the top perimeter edge and curve downward toward an elliptical shape as the battling surfaces slope away from the top perimeter edge.

The irregular and non-circular top perimeter edge of the asymmetrical concave bowl-shaped battling stadium, as clearly seen in FIGS. 7 & 8, creates a random battling surface area of concave and convex sloping surfaces extending from edge 74 toward the central area 22 creating surfaces which speed up and slow down spinning tops at various sections along the battling surfaces promoting random movements of hypersphere tops in battle to enhance and extend game play. The four inclined battling surfaces blend downward from a semi-circular shape toward an elliptical shape as the battling surfaces slope away from the irregular top perimeter edge defining surfaces which either speed up or slow down spinning tops promoting a dynamic battling environment. Additionally, the asymmetrical concave bowl-shaped battling surfaces continually redirect tops at the periphery of the bowl into the middle of the stadium for battle, diminishing the frequency of tops jumping the edge/rim 74 for increasing interactions between actively spinning tops about and around the battling surface extending game play.

FIG. 8 shows a series of lofted curved planar sections illustrating a series of alternating arcs forming a closed upper battling surface for generating asymmetrical aspects in the battling surfaces of the concaved bowl of the apparatus 10. Concave surfaces, which are mainly seen at the banked corners 32, 42, 52, & 62, of the battling surface 18*a*, alternate with convex surfaces, which are mainly seen in the battling surfaces which are defined in between the banked corners. Alternating concave and convex arcs emanate out from a central point at the central area 22, to the top edge 74, as seen in FIG. 8. Concave arcs emanate out from the central point toward the top edge of each banked corner of each quadrant, and convex arcs emanate out from the central point toward the top edge in between each concave arc.

FIG. 8A shows a side view of the lofted battling surfaces of the concave bowl portion as defined by the curved sections of FIG. 8. The series of alternating arcs generate the asymmetrical aspects in the battling surfaces and define the irregular non-circular perimeter of bowl-shaped stadium.

Tops spinning about the irregular battling surface of the present described embodiment, will alternate between different contoured surfaces, generally concave and convex surfaces, and either speed up or slow down depending upon the curvature of the surface on which the tops are spinning. The circular diameter and/or elliptical radius of the portions of the battling surfaces upon which the tops are spinning will randomly change to create interesting top action that continually redirects tops at multiple turns and bends around the battling surfaces. Generally, as spinning tops ride along the concave banked corners of the inclined battling surfaces, the tops will speed up and gain acceleration through the turns and curvature of the banked corners. Spinning tops ridding along the generally convex and more elliptical portions of the inclined battling surfaces will slow down and lose acceleration, both diminishing the frequency of tops jumping the edge/rim and spinning off the battling surfaces as well as redirecting spinning tops toward the central area of the battling surface. The generally convex and more elongated elliptical portions of the inclined battling surfaces will interrupt the acceleration of spinning tops at the concaved banked corners to preserve top energy and create more interesting and extended game play.

Alternatively, traditional circular toy stadiums include symmetrical inclined battling surfaces defining a circular top perimeter edge creating only one type of mostly concave surface throughout the battling stadium, as opposed to a variety of angled, arced, and generally concave and convex surfaces of the battling stadium of present described embodiment, as seen in FIGS. 7 & 8. The symmetry of a traditional circular stadium creates an inclined battling surface that is equal in slope, arc and diameter as measured all around the entire battling stadium. Tops spinning around a traditional circular stadium will continually speed up as if the tops are perpetually contacting a concaved banked surface and gravity will frequently carry the tops out of the battling stadium. Tops spinning around a traditional circular stadium are not interrupted by a variety of turns, bends and convex surfaces upon which to redirect the spinning tops in a random fashion for a more interesting and extended game play.

Figure 4:
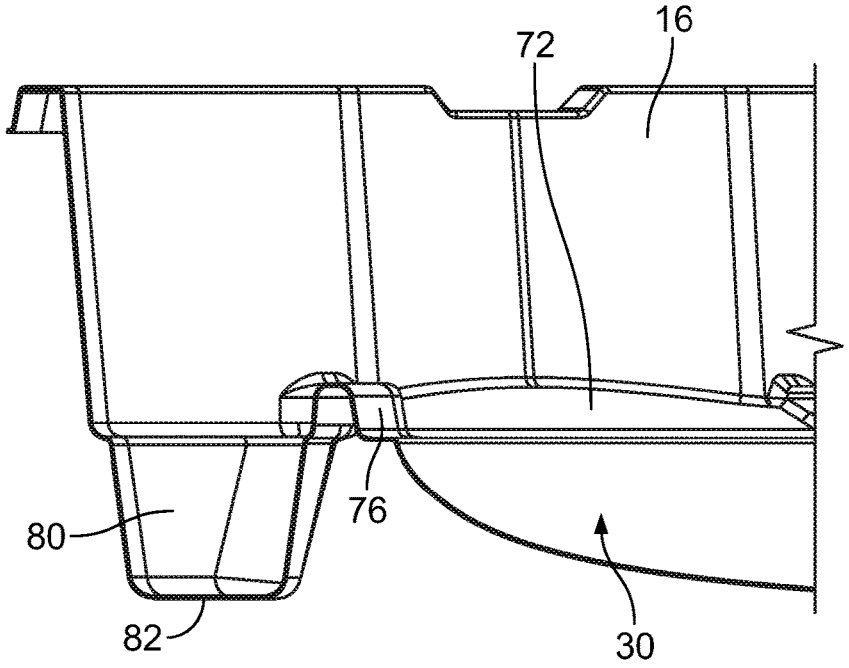
FIGS. 4 and 4A are cross sectional views of the battling stadium apparatus, illustrating well and foot elements and a deep-seated semi-circular inclined battling surface.

The second tier 14 is disposed atop the first tier 12, as seen in FIGS. 1 & 4, and extends generally around the entire perimeter of the bowl-shaped stadium at the edge/border rim 74 between the first tier and the second tier. The edge/rim 74 defines the upper edge of the four semi-circular inclined battling surfaces, creating a deep-seated asymmetrical stadium bowl for generating unpredictable spinning top action for exciting and dynamic game play in a relatively small arena.

A border wall 76 is disposed at the second tier, generally at the rim 74 between first and second tiers at the banked corner of one or more of the four semi-circular inclined battling surfaces, as seen in FIGS. 1 & 4. In the present described embodiment, a border wall 76 is disposed at each of the banked corners of each of the four semi-circular inclined surfaces. The boarder walls 76 are generally low in height and integral with the one-piece molded plastic stadium.

The second tier 14 also includes a riding platform surface 72 disposed at the boarder rim 74 between the first and second tiers, but extends out to the stadium wall only at areas along the second tier which are between the border walls 76. Spinning tops ascending the semi-circular battling surfaces may over-ride the rim 74 and travel onto the riding platform surface 72 where the spinning tops are then redirected back into the middle of the stadium bowl 18. Additionally, spinning tops may be introduced into the battling stadium at the riding platform surface 72 rather than directly into the asymmetrical battling environment.

The riding platform surface 72 includes an inclined portion 78, as seen in FIG. 1, extending from the rim 74 toward the stadium wall 16 for redirecting spinning tops ridding on the second tier back into the middle of the first tier of the stadium bowl. Spinning tops usually stay within the stadium bowl, as described above, unless bumped hard by another spinning top or if launched into the stadium bowl with a high RPM. The small stadium bowl area and its irregular shape usually prevent spinning tops from over-driving the rim too often.

Figure 4A:
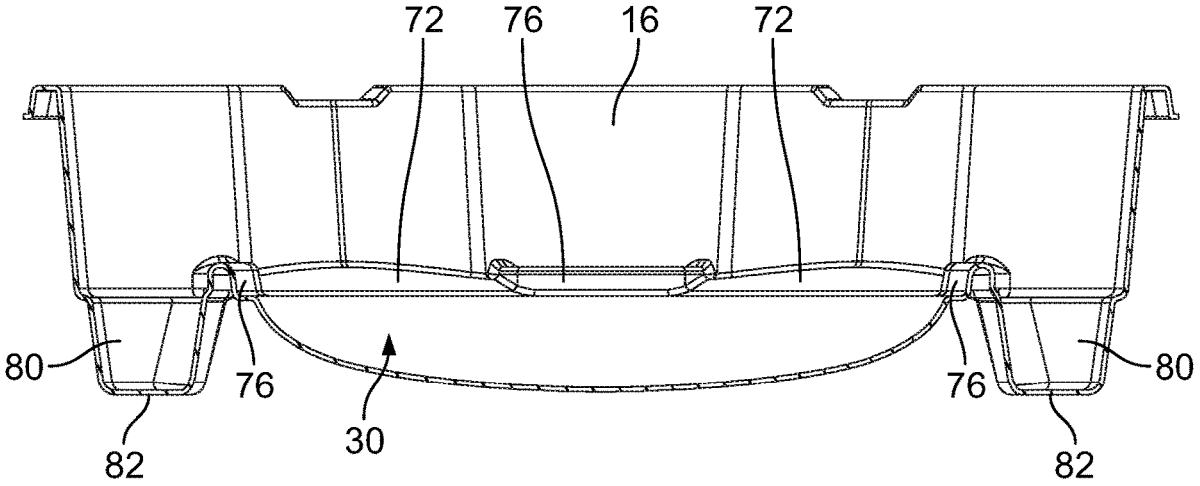

One or more wells/pockets 80 defined by the one or more border walls 76 and disposed at one or more banked corners, capture exiting tops spun beyond the first and second tiers of the battling stadium, as seen in FIGS. 1, 4 & 4A. In the present described embodiment, a well 80 is defined by each of the four border walls 76 at a banked corner of each of the four semi-circular inclined battling surfaces of the stadium bowl. The border walls 76 are low in height but sufficient to keep spinning tops from falling into the wells too often in order to maintain engaging game play. Additionally, a well 80 disposed at each of the four banked corners, provide feet 82 underneath the battling stadium, opposite the battling surface, as seen in FIGS. 2 & 4, situated at an outer perimeter of each of the four quadrant areas of the stadium bowl to securely and stably sit the battling stadium in use.

Additionally, one or more of the four semi-circular inclined/concave battling surfaces extends from the border rim 74 at a sharp angle defining a sharp incline into a deep-seated battling surface, as seen FIGS. 1, 2 & 4. In the present described embodiment, all four semi-circular inclined battling surfaces, 30, 40, 50, & 60, extend from the border rim 74 at a sharp angle defining a sharp incline into a deep-seated battling surface, however the stadium bowl remains asymmetrical because each partial sphere defining each semi-circle differs in size as demonstrated by the various lengths of the first, second, third and fourth radii, as seen in FIG. 3.

The four inclined battling surfaces define the asymmetrical concave bowl-shaped battling surface such that the inclined surfaces are semi-circular in shape at the top perimeter edge and blend downward toward an elliptical shape as the battling surfaces slope away from the top perimeter edge. As seen in FIG. 9, the elliptical shape of the battling surfaces toward the central area of the concaved bowl-shaped battling stadium form a partial ellipse and are shallower at the central area, than the sharp inclined surfaces of the banked corners defining the deep-seated surfaces.

Figure 5:
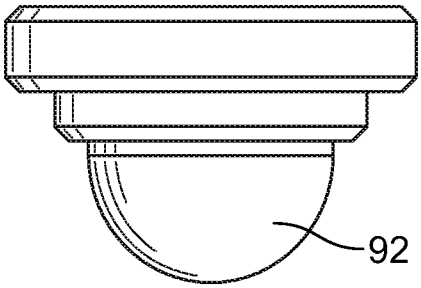
FIG. 5 illustrate an exemplary basic top in accordance with the described embodiments for battling arenas of FIGS. 6A and 10 discussed below utilizing, e.g., wide U-shaped tips, which may provide enhanced contacting and spinning of the top along the deep-seated asymmetrical stadium bowl at an enhanced acceleration, enhancing game play for the user by maximizing random and dynamic interactions between actively spinning tops about and around the asymmetrical concave bowl-shaped battling surface for maximizing random and aggressive top actions and interactions between actively spinning tops about and around the asymmetrical concave bowl-shaped battling surface.
Figure 6:
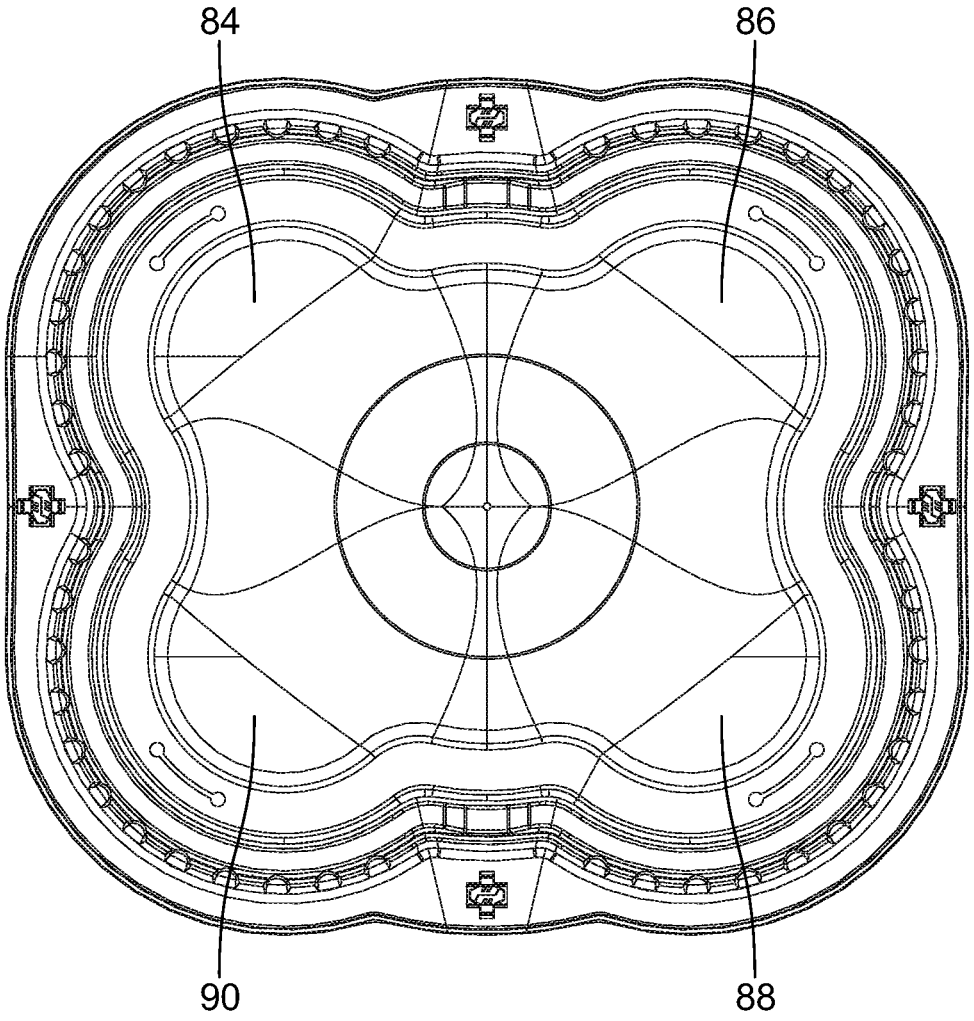
FIGS. 6 and 6A illustrate an alternative asymmetrical battling stadium including first, second, third and fourth partial sphere midpoints delineating a parallelogram with right angles connecting each of the first, second, third, and fourth midpoints creating an asymmetrical battling environment at the four semi-circular inclined batting surfaces of the bowl-shaped stadium; the plan view of a battling stadium apparatus of the present embodiments have first, second, third and fourth partial sphere midpoints collectively delineating a parallelogram with or without right angles, and in other words illustrating four semi-circular areas/quadrants each having an extent determined by a length of a radius from a specified point in a central area of an asymmetrical concaved bowl-shaped surface, such that the four specified points delineate four corners of a parallelogram with or without right angles.
Figure 6A:
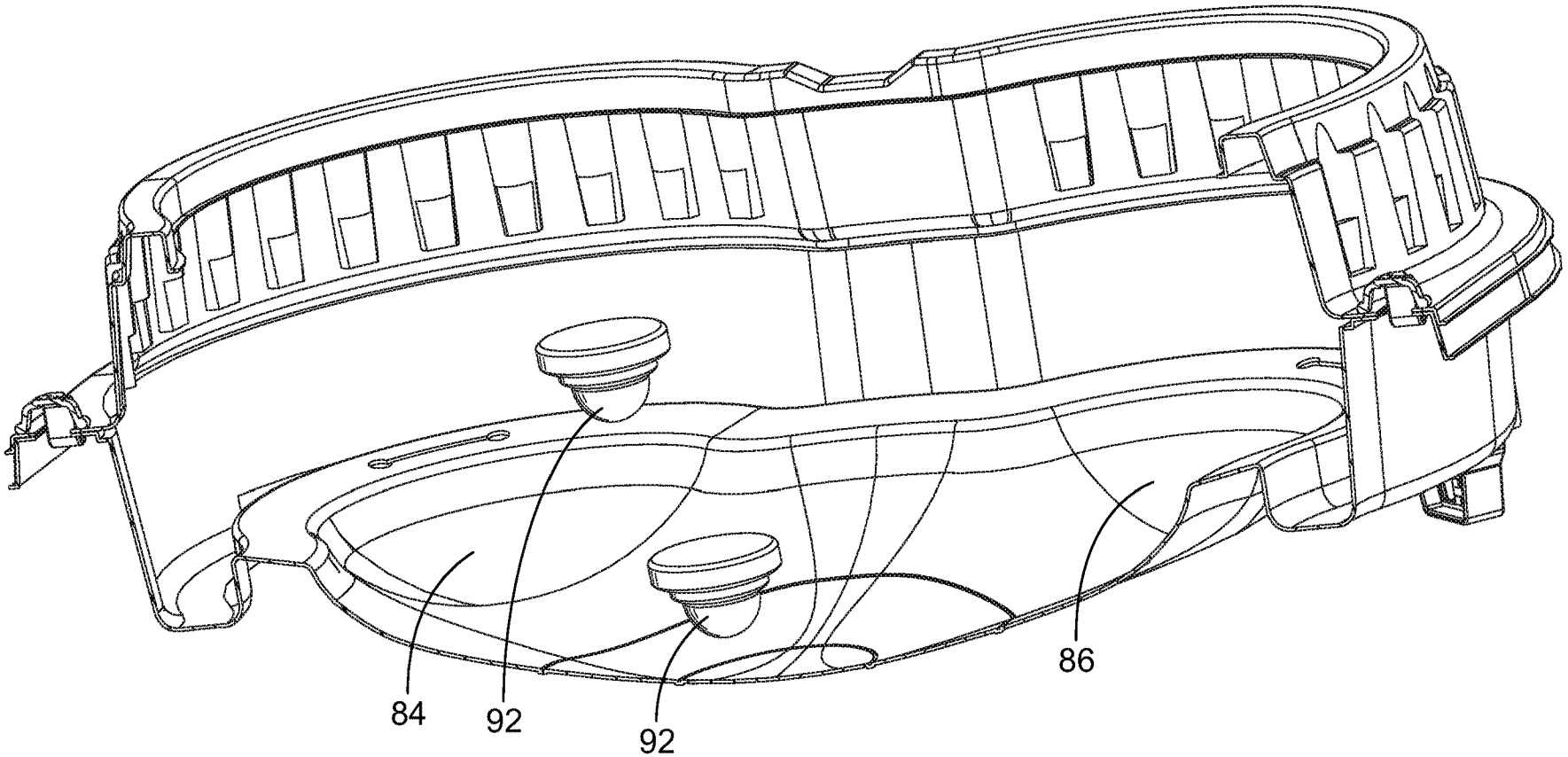
Figure 10:
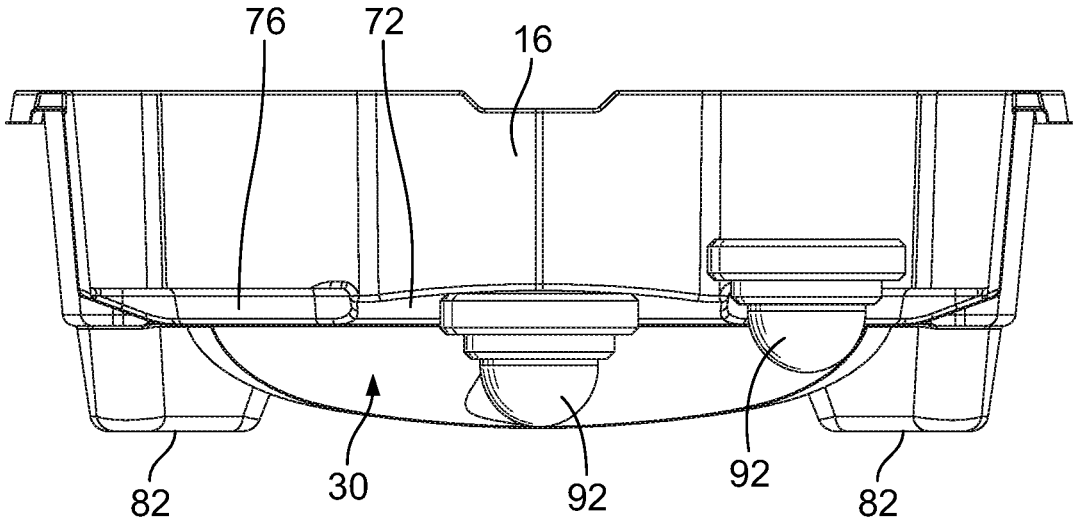
FIG. 10 is a hypersphere top of FIG. 5 including a wide U-shaped tip and further illustrating the top contacting the central area of the battling surface at only an end portion of the tip of the top, and the top contacting a banked corner/wall portion of the battling surface engaging an entire side of the tip of top for faster forward motion at the banked corner/wall.

In combination, the battling stadium apparatus and a spinning top/hypersphere top having a wide U-shaped tip 92, as seen in FIGS. 5, 6A and 10, provides enhanced contacting and spinning of the tops along the deep-seated asymmetrical stadium bowl at an enhanced acceleration. The wide U-shaped tip travels faster and further up the four banked corners of the four semi-circular inclined battling surfaces enhancing game play for the user by maximizing random and dynamic interactions between actively spinning tops about and around the asymmetrical concave bowl-shaped battling surface.

Tops spinning about the irregular battling surface of the present described embodiment, will alternate between different contoured surfaces and either speed up or slow down depending upon the curvature of the surface on which the tops are spinning. The diagonal ellipse surfaces at the stadium bowl, as seen in FIG. 7 will slow down circulation of spinning tops as the tops exit the banked corners at advanced acceleration.

Spinning tops of the present described embodiment, and seen in FIG. 10, will generally climb along the diagonally opposed spherical corners due to momentum of the spinning tops at the corners as well as the enhanced frictional engagement of each top as it is lying partially on its side when contacting the corners of the bowl. Spinning tops at the spherical corners are contacting the battling surfaces of the stadium at more than one point and achieving a high velocity at the spherical corners due to the larger radius location of the top that's in contact with the stadium surface. Spinning tops will have a faster forward motion when engaging the steeper wall sections. In other words, spinning tops will grip the battling surface at the spherical corners with more of the outer surface of the tip of the top encouraging the top to climb up the inclined surface toward the edge 74 of the bowl. Additionally, the curvature of the tip of the hypersphere top as seen in FIG. 10 matches the curvature of the spherical corner surfaces enhancing the ability of the top to climb up the spherical corners.

In contrast, at the longer horizontal spans (the elliptical portions of the battling surfaces) between the diagonally opposed corners, the slope of the battling surface is shallow and the forward velocity is less, as the radius point at which the top contacts the stadium will be smaller, as seen in FIG. 10. The top at the central area and out into the elliptical portions of the battling surfaces will be more upright with less of the surface of the tip of the top contacting the battling surfaces.

Various styles of wide U-shaped tips may be employed for dynamic top actions which enhance game play for the user as shown in FIG. 5, and all are employed for maximizing random and aggressive top actions and interactions between actively spinning tops about and around the asymmetrical concave bowl-shaped battling surface. The various tip patterns and designs creates a unique top action which enhances game play.

The various asymmetrical battling stadium as disclosed herein includes first, second, third and fourth partial sphere midpoints delineating a parallelogram without right angles connecting each of the first, second, third, and fourth midpoints creating an asymmetrical battling environment at the four semi-circular inclined batting surfaces of the bowl-shaped stadium. In an alternative battling stadium, as seen in FIGS. 6 and 6A, it will be appreciated that the first, second, third and fourth partial sphere midpoints delineating the parallelogram with right angles, such as a rectangle shape, connecting each of the first, second, third, and fourth midpoints creating an asymmetrical battling environment at the four semi-circular inclined batting surfaces of the bowl-shaped stadium. In the present described alternative embodiment, semi-circular inclined battling surfaces 84-90, as seen in FIG. 6, are each defined by a partial sphere, as described above, and include a radius which comes to a terminus defining a midpoint of a respective sphere collectively delineating a rectangle, with or without right angles, creating an asymmetrical battling environment at the four semi-circular inclined battling surfaces.

An alternatively described toy stadium apparatus for battling tops 10 includes a first tier battling arena 12 having a concave bowl-shaped surface 18*a* having a central area 22 and first, second, third and fourth quadrant areas along the periphery of the central area, 22, 24, 26, & 28, respectively. The quadrant areas each being adjacent the central area and inclined therefrom, as seen in FIGS. 1-2. A first partial sphere 34 defines a banked surface at the first quadrant area 22 with a corner 32 defined by a first semi-circular area 30 having an extent determined by the length of a first radius 36 from a first specified point 38 in the central area 20 of the concave bowl-shaped surface 18*a*. A second partial sphere 44 defines a banked surface at the second quadrant area 24 with a corner 42 defined by a second semi-circular area 40 having an extent determined by the length of a second radius 46 from a second specified point 48 in the central area 20 of the concave bowl-shaped surface 18*a*.

Likewise, a third partial sphere 54 defining a banked surface at the third quadrant area 26 with a corner 52 defined by a third semi-circular area 50 having an extent determined by the length of a third radius 56 from a third specified point 58 in the central area 20 of the concave bowl-shaped surface 18*a*, and a fourth partial sphere 64 defining a banked surface at the fourth quadrant area 28 with a corner 62 defined by a fourth semi-circular area 60 having an extent determined by the length of a fourth radius 66 from a fourth specified point 68 in the central area 20 of the concave bowl-shaped surface 18*a*. The first, second, third and fourth specified points in the central area from which each respective first, second, third and fourth radii emanates together delineate the four corner points of an irregular quadrilateral connecting said first, second, third and fourth specified points, wherein each of the first, second, third and fourth partial sphere banked surfaces define an asymmetrical battling surface.

The toy stadium 10 further includes a second tier 14 atop the first tier 12 including a riding platform surface 72 disposed at a border/rim 74 between the first and second tiers, the border/rim 74 defining an upper edge of the four partial sphere banked surfaces creating a deep-seated asymmetrical stadium bowl generating unpredictable top action for exciting and dynamic game play in a relatively small arena. The toy stadium includes a border wall 76 adjacent the border/rim 74 between first and second tiers disposed at one or more of the corners at the quadrant areas of one or more of the four semi-circular battling surfaces 30, 40, 50 & 60. The toy stadium 10 further includes one or more wells 80 defined by the one or more border walls for capturing exiting tops spun beyond first and second tiers of the battling stadium.

An alternative asymmetrical battling stadium, as seen in FIG. 6, includes first, second, third and fourth specified points 38, 48, 58, & 68 in the central area 20 from which each respective first, second, third and fourth radii emanates together delineating the four corner points of a parallelogram with right angles, such as a rectangle shape, connecting said first, second, third and fourth specified points, wherein each of the first, second, third and fourth partial sphere banked surfaces define an asymmetrical battling surface 18*a*. Additionally, another alternative asymmetrical battling stadium, as seen in FIG. 6, includes first, second, third and fourth specified points 38, 48, 58, & 68, in the central area from which each respective first, second, third and fourth radii emanates together delineating the four corner points of a parallelogram without right angles connecting said first, second, third and fourth specified points, wherein each of the first, second, third and fourth partial sphere banked surfaces define an asymmetrical battling surface 18*a*.

One or more of the four semi-circular areas of one or more of the four quadrant areas includes an inclined battling surface which extends from the border between then first and second tiers at a sharp angle defining a sharp incline into a deep-seated battling surface. In the present described embodiment, each of the four semi-circular areas 30, 40, 50, & 60, includes an inclined battling surface which extends from the border between the first and second tiers at a sharp angle defining a sharp incline into a deep-seated battling surface.

The riding platform surface 72 of the second tier includes an inclined portion 78 for directing tops riding on the second tier back into the central area of the first tier of the concave bowl-shaped surface 18*a*. Additionally, the battling stadium 10 is in combination with a top having a wide U-shaped tip for contacting and spinning along the deep-seated asymmetrical concave bowl-shaped surface at an enhanced acceleration.

A method for manufacturing an asymmetrical battling stadium, includes the steps of providing a first tier having a concave bowl-shaped surface with a central area and first, second, third, and fourth quadrant areas along the periphery of the central area, each of the quadrant areas being adjacent the central area and inclined therefrom, positioning a first partial sphere banked surfaces at the first quadrant area with a corner defined by a first semi-circular area having an extent determined by the length of a first radius from a specified point in the central area of the concave bowl-shaped surface, and positioning a second partial sphere banked surface at the second quadrant area with a corner defined by a second semi-circular area having an extent determined by the length of a second radius from a second specified point in the central area of the concave bowl-shaped surface. Positioning a third partial sphere banked surface at the third quadrant area with a corner defined by a third semi-circular area having an extent determined by the length of a third radius from a third specified point in the central area of the concave bowl-shaped surface, and positioning a fourth partial sphere banked surface at the fourth quadrant area with a corner defined by a fourth semi-circular area having an extent determined by the length of a fourth radius from a fourth specified point in the central area of the concave bowl-shaped surface. Connecting the first, second, third and fourth specified points in the central area from which each respective first, second, third and fourth radii emanates delineating the four corner points of an irregular quadrilateral wherein each of the first, second, third and fourth partial sphere banked surfaces are defining an asymmetrical battling surface.

The method of manufacturing an asymmetrical battling surface, further includes the steps of providing a second tier atop the first tier, and providing a riding platform surface disposed at a border between the first and second tiers, the border defining an upper edge of the four partial sphere banked surfaces creating a deep-seated asymmetrical stadium bowl generating unpredictable top action for exciting and dynamic game play in a relatively small arena.

What is claimed is:

1. A battling stadium apparatus for tops with an asymmetrical battling surface, comprising:

a first tier having a concave bowl-shaped stadium including four inclined battling surface curved regions;

a first inclined battling surface curved region including a banked corner defined by a first arc segment having a first radius prescribing a midpoint of the first arc segment;

a second inclined battling surface curved region including a banked corner defined by a second arc segment having a second radius prescribing a midpoint of the second arc segment;

a third inclined battling surface curved region including a banked corner defined by a third arc segment having a third radius prescribing a midpoint of the third arc segment;

a fourth inclined battling surface curved region including a banked corner defined by a fourth arc segment having a fourth radius prescribing a midpoint of the fourth arc segment; and first, second, third and fourth radii each come to a terminus defining a midpoint of a respective arc segment collectively delineating an irregular quadrilateral connecting each of the first, second, third and fourth midpoints creating an asymmetrical battling environment at the four inclined battling surface curved regions of the bowl-shaped stadium.

2. The battling stadium apparatus according to claim 1, further including a second tier atop the first tier including a riding platform surface disposed at a border rim between the first and second tiers, the rim defining an upper edge of the four inclined battling surface curved regions creating a deep-seated asymmetrical stadium bowl generating unpredictable spinning top action for exciting and dynamic game play in a relatively small arena.

3. The battling stadium apparatus according to claim 2, further including a border wall adjacent the rim between first and second tiers disposed at the banked corner of one or more of the four inclined battling surface curved regions.

4. The battling stadium apparatus according to claim 3, further comprising one or more wells defined by the one or more border walls for capturing exiting tops spun beyond first and second tiers of the battling stadium.

5. The battling stadium apparatus according to claim 4, wherein first, second, third and fourth arc segment midpoints collectively delineate a parallelogram without right angles connecting each of the first, second, third and fourth midpoints creating an asymmetrical battling environment at the four inclined battling surface curved regions of the bowl-shaped stadium.

6. The battling stadium apparatus according to claim 4, wherein first, second, third and fourth arc segment midpoints collectively delineate a parallelogram with right angles connecting each of the first, second, third and fourth midpoints creating an asymmetrical battling environment at the four inclined battling surface curved regions of the bowl-shaped stadium.

7. The battling stadium apparatus according to claim 5, wherein one or more of the four inclined battling surface curved regions extends from the border rim at a sharp angle defining a sharp incline into a deep-seated battling surface.

8. The battling stadium apparatus according to claim 7, wherein the riding platform surface of the second tier includes an inclined portion for redirecting tops riding on the second tier back into the middle of the first tier of the stadium bowl.

9. The battling stadium apparatus according to claim 8, in combination with a top having a wide U-shaped tip for contacting and spinning along the deep-seated asymmetrical stadium bowl at an enhanced acceleration.

10. A toy stadium apparatus for battling tops, comprising:

a first tier battling arena having a concave bowl-shaped surface having a central area and first, second, third and fourth quadrant areas along the periphery of the central area, said quadrant areas each being adjacent the central area and inclined therefrom;

a first arc segment banked surface at the first quadrant area with a corner defined by a first inclined battling surface curved region having an extent determined by the length of a first radius from a first specified point in the central area of the concave bowl-shaped surface;

a second arc segment banked surface at the second quadrant area with a corner defined by a second inclined battling surface curved region having an extent determined by the length of a second radius from a second specified point in the central area of the concave bowl-shaped surface;

a third arc segment banked surface at the third quadrant area with a corner defined by a third inclined battling surface curved region having an extent determined by the length of a third radius from a third specified point in the central area of the concave bowl-shaped surface;

a fourth arc segment banked surface at the fourth quadrant area with a corner defined by a fourth inclined battling surface curved region having an extent determined by the length of a fourth radius from a fourth specified point in the central area of the concave bowl-shaped surface; and said first, second, third and fourth specified points in the central area from which each respective first, second, third and fourth radii emanates together delineate the four corner points of an irregular quadrilateral connecting said first, second, third and fourth specified points, wherein each of the first, second, third and fourth arc segment banked surfaces define an asymmetrical battling surface.

11. The battling stadium apparatus according to claim 10, further including a second tier atop the first tier including a riding platform surface disposed at a border between the first and second tiers, the border defining an upper edge of the four arc segment banked surfaces creating a deep-seated asymmetrical stadium bowl generating unpredictable top action for exciting and dynamic game play in a relatively small arena.

12. The battling stadium apparatus according to claim 11, further comprising a border wall adjacent the border between first and second tiers disposed at one or more of the corners at the quadrant areas of one or more of the four inclined battling surface curved regions.

13. The battling stadium apparatus according to claim 12, further comprising one or more wells defined by the one or more border walls for capturing exiting tops spun beyond first and second tiers of the battling stadium.

14. The battling stadium apparatus according to claim 13, wherein first, second, third and fourth specified points in the central area from which each respective first, second, third and fourth radii emanates together delineate the four corner points of a parallelogram without right angles connecting said first, second, third and fourth specified points, wherein each of the first, second, third and fourth arc segment banked surfaces define an asymmetrical battling surface.

15. The battling stadium apparatus according to claim 13, wherein first, second, third and fourth specified points in the central area from which each respective first, second, third and fourth radii emanates together delineate the four corner points of a parallelogram with right angles connecting said first, second, third and fourth specified points, wherein each of the first, second, third and fourth arc segment banked surfaces define an asymmetrical battling surface.

16. The battling stadium apparatus according to claim 14, wherein one or more of the four inclined battling surface curved regions of one or more of the four quadrant areas includes an inclined battling surface which extends from the border between then first and second tiers at a sharp angle defining a sharp incline into a deep-seated battling surface.

17. The battling stadium apparatus according to claim 16, wherein the riding platform surface of the second tier includes an inclined portion for directing tops riding on the second tier back into the central area of the first tier of the concave bowl-shaped surface.

18. The battling stadium apparatus according to claim 17, in combination with a top having a wide U-shaped tip for contacting and spinning along the deep-seated asymmetrical concave bowl-shaped surface at an enhanced acceleration.

19. A method for manufacturing an asymmetrical battling stadium, comprising the steps of:

providing a first tier having a concave bowl-shaped surface with a central area and first, second, third, and fourth quadrant areas along the periphery of the central area, each of the quadrant areas being adjacent the central area and inclined therefrom;

positioning a first arc segment banked surfaces at the first quadrant area with a corner defined by a first inclined battling surface curved region having an extent determined by the length of a first radius from a specified point in the central area of the concave bowl-shaped surface;

positioning a second arc segment banked surface at the second quadrant area with a corner defined by a second inclined battling surface curved region having an extent determined by the length of a second radius from a second specified point in the central area of the concave bowl-shaped surface;

positioning a third arc segment banked surface at the third quadrant area with a corner defined by a third inclined battling surface curved region having an extent determined by the length of a third radius from a third specified point in the central area of the concave bowl-shaped surface;

positioning a fourth arc segment banked surface at the fourth quadrant area with a corner defined by a fourth inclined battling surface curved region having an extent determined by the length of a fourth radius from a fourth specified point in the central area of the concave bowl-shaped surface; and connecting said first, second, third and fourth specified points in the central area from which each respective first, second, third and fourth radii emanates, delineating the four corner points of an irregular quadrilateral wherein each of the first, second, third and fourth arc segment banked surfaces are defining an asymmetrical battling surface.

20. The method of manufacturing an asymmetrical battling surface according to claim 19, further comprising providing a second tier atop the first tier, and providing a riding platform surface disposed at a border between the first and second tiers, the border defining an upper edge of the four arc segment banked surfaces creating a deep-seated asymmetrical stadium bowl generating unpredictable top action for exciting and dynamic game play in a relatively small arena.

* * * * *